US012018452B2

(12) United States Patent
Konda et al.

(10) Patent No.: US 12,018,452 B2
(45) Date of Patent: Jun. 25, 2024

(54) WORK MACHINE, SYSTEM, AND METHOD OF CONTROLLING WORK MACHINE

(71) Applicant: KOMATSU LTD., Tokyo (JP)

(72) Inventors: Tomoki Konda, Tokyo (JP); Kenjiro Shimada, Tokyo (JP)

(73) Assignee: KOMATSU LTD., Tokyo (JP)

( * ) Notice: Subject to any disclaimer, the term of this patent is extended or adjusted under 35 U.S.C. 154(b) by 271 days.

(21) Appl. No.: 17/603,102

(22) PCT Filed: May 25, 2020

(86) PCT No.: PCT/JP2020/020445

§ 371 (c)(1),
(2) Date: Oct. 12, 2021

(87) PCT Pub. No.: WO2020/255635

PCT Pub. Date: Dec. 24, 2020

(65) Prior Publication Data

US 2022/0186461 A1 Jun. 16, 2022

(30) Foreign Application Priority Data

Jun. 18, 2019 (JP) ..... 2019-112654

(51) Int. Cl.

| | |
|---|---|
| ***E02F 3/43*** | (2006.01) |
| ***E02F 9/22*** | (2006.01) |
| ***E02F 9/24*** | (2006.01) |
| *E02F 3/32* | (2006.01) |

(52) U.S. Cl.

CPC ..... *E02F 3/439* (2013.01); *E02F 9/24* (2013.01); *E02F 3/32* (2013.01); *E02F 9/2228* (2013.01); *E02F 9/2285* (2013.01); *E02F 9/2296* (2013.01)

(58) Field of Classification Search

CPC ..... E02F 3/439; E02F 9/24; E02F 3/32; E02F 9/2228; E02F 9/2285; E02F 9/2296; E02F 9/265; E02F 9/262; E02F 9/205; E02F 3/43; E02F 9/2033; E02F 9/2054

USPC ..... 701/50

See application file for complete search history.

(56) References Cited

U.S. PATENT DOCUMENTS

| | | | | |
|---|---|---|---|---|
| 2005/0000703 | A1* | 1/2005 | Furuno | G01G 19/08 172/2 |
| 2011/0295433 | A1* | 12/2011 | Evans | B60W 10/08 700/282 |
| 2015/0147147 | A1 | 5/2015 | Uchiyama | |
| 2016/0078340 | A1* | 3/2016 | Kirsch | G06N 5/022 706/12 |

(Continued)

FOREIGN PATENT DOCUMENTS

| | | | |
|---|---|---|---|
| CN | 108474195 | A | 8/2018 |
| JP | H02-088825 | A | 3/1990 |

(Continued)

*Primary Examiner* — Tyler D Paige

(74) *Attorney, Agent, or Firm* — Faegre Drinker Biddle & Reath LLP

(57) ABSTRACT

A hydraulic excavator loads a load onto a loaded machine. The hydraulic excavator includes a work implement and a controller. The work implement includes a bucket. The controller senses an amount of natural lowering of the bucket in a stand-by state in which the hydraulic excavator waits for entry of the loaded machine and controls the work implement to raise the bucket based on the amount of natural lowering.

10 Claims, 6 Drawing Sheets

(56) References Cited

U.S. PATENT DOCUMENTS

| | | | | |
|---|---|---|---|---|
| 2018/0305902 | A1 | 10/2018 | Tsukamoto | |
| 2020/0018037 | A1* | 1/2020 | Nakamura | E02F 3/43 |
| 2020/0283993 | A1 | 9/2020 | Minagawa et al. | |
| 2021/0010239 | A1* | 1/2021 | Ono | E02F 9/2041 |

FOREIGN PATENT DOCUMENTS

| | | | |
|---|---|---|---|
| JP | H11-181821 | A | 7/1999 |
| JP | 2001-342648 | A | 12/2001 |
| JP | 2003-322112 | A | 11/2003 |
| JP | 3845597 | B2 | 11/2006 |
| JP | 2011-094453 | A | 5/2011 |
| JP | 5526299 | B1 | 6/2014 |
| JP | 5752350 | B2 | 7/2015 |
| JP | 2016-089389 | A | 5/2016 |
| JP | 2016-089559 | A | 5/2016 |
| JP | 6345080 | B2 | 6/2018 |
| JP | 6373728 | B2 | 8/2018 |
| JP | 2019-065660 | A | 4/2019 |
| KR | 10-2018-0097614 | A | 8/2018 |
| WO | WO-2017/115809 | A1 | 7/2017 |

* cited by examiner

WORK MACHINE, SYSTEM, AND METHOD OF CONTROLLING WORK MACHINE

TECHNICAL FIELD

The present disclosure relates to a work machine, a system, and a method of controlling a work machine.

BACKGROUND ART

In a work machine such as a hydraulic excavator, a bucket may naturally fall while the work machine waits for a dump truck with the bucket carrying a load. Natural fall of the bucket occurs due to a self-weight of the bucket, a weight of a load, leakage of hydraulic oil through a gap around a spool in a main valve, or leakage of hydraulic oil from the inside of a cylinder. Japanese Patent Laying-Open No. 2-88825 (see PTL 1) describes providing a pilot operation check valve in a circuit for activating a boom cylinder in order to prevent natural fall of the bucket.

CITATION LIST

Patent Literature

PTL 1: Japanese Patent Laying-Open No. 2-88825

SUMMARY OF INVENTION

Technical Problem

According to a technique described in PTL 1, however, when a hydraulic excavator waits for arrival of a loaded machine such as a dump truck with a bucket carrying a load, natural fall of the bucket cannot completely be prevented. When the bucket naturally falls, the bucket may interfere with the loaded machine at the time of entry of the loaded machine.

An object of the present disclosure is to provide a work machine, a system, and a method of controlling a work machine that allow avoidance of interference of a bucket with a loaded machine at the time of entry of the loaded machine.

Solution to Problem

A work machine in the present disclosure is a work machine that loads a load onto a loaded machine, and the work machine includes a work implement and a controller. The work implement includes a bucket. The controller senses an amount of natural lowering of the bucket in a stand-by state in which the work machine waits for entry of the loaded machine and controls the work implement to raise the bucket based on the amount of natural lowering.

Advantageous Effects of Invention

According to the present disclosure, a work machine, a system, and a method of controlling a work machine that allow avoidance of interference of a bucket with a loaded machine at the time of entry of the loaded machine can be provided.

DESCRIPTION OF EMBODIMENTS

Figure 1:
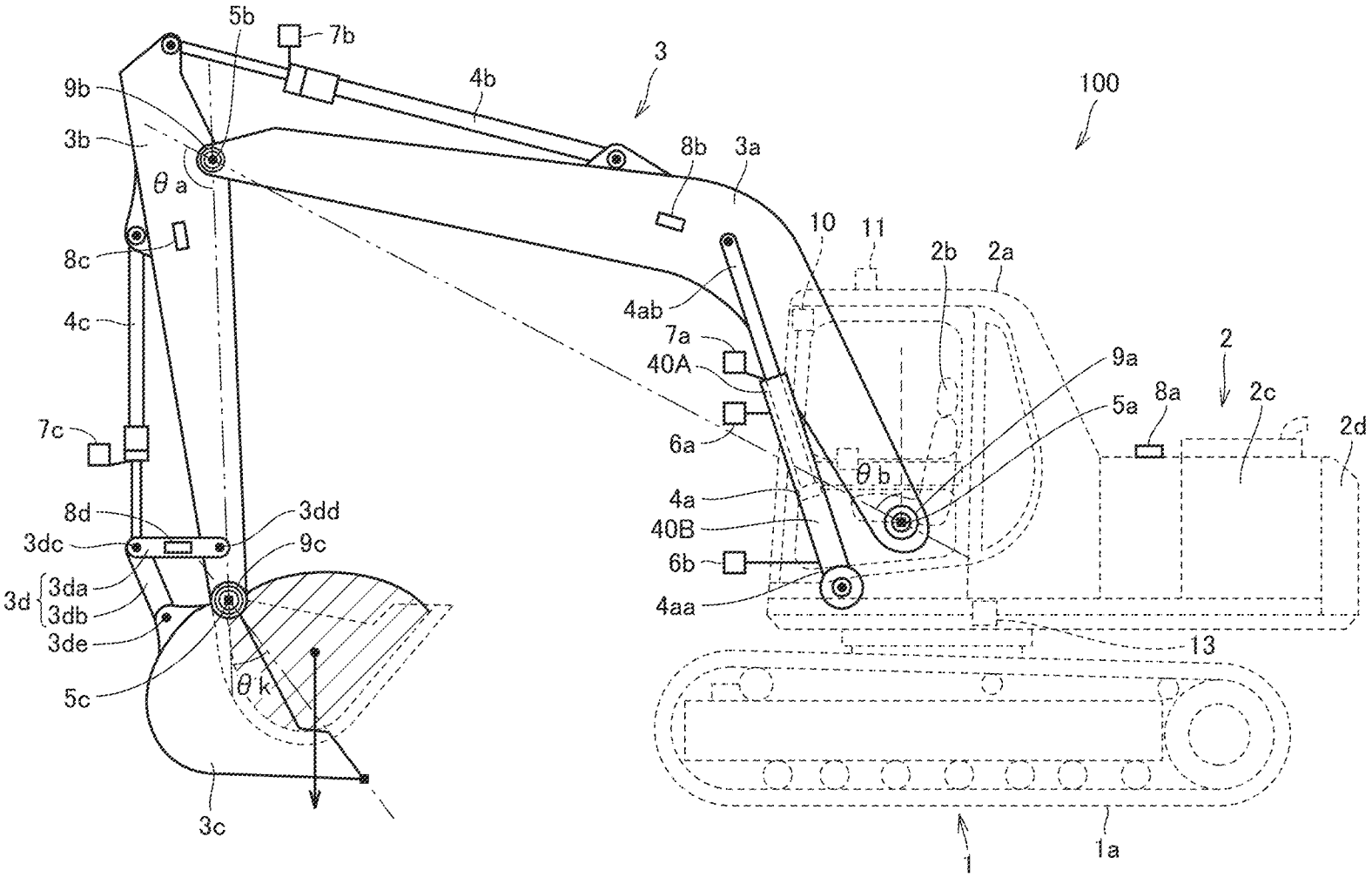
FIG. 1 is a diagram schematically showing a construction of a work machine in one embodiment of the present disclosure.

An embodiment of the present disclosure will be described below with reference to the drawings.

The same or corresponding constituent elements in the specification and the drawings have the same reference characters allotted and redundant thereof will not be repeated. For the sake of convenience of description, a feature in the drawings may not be shown or may be simplified.

Though a hydraulic excavator is described by way of example of a work machine in the present disclosure, the present disclosure is applicable to a work machine including a bucket, other than the hydraulic excavator. The present disclosure is applicable, for example, also to a crane, an ultra large rope excavator that is not hydraulically driven, and an ultra large electric excavator driven by an electric motor. In the description below, "upward", "downward", "front", "rear", "left", and "right" refer to directions with an operator sitting in an operator's seat 2*b* in an operator's cab 2*a* being defined as the reference.

<Construction of Work Machine>

FIG. 1 is a side view schematically showing a construction of a hydraulic excavator by way of example of a work machine in one embodiment of the present disclosure. As shown in FIG. 1, a hydraulic excavator 100 in the present embodiment mainly includes a traveling unit 1, a revolving unit 2, and a work implement 3. A main body of the work machine is constituted of traveling unit 1 and revolving unit 2.

Traveling unit 1 includes a pair of left and right crawler belt apparatuses 1*a*. Each of the pair of left and right crawler belt apparatuses 1*a* includes a crawler belt. As the pair of left and right crawler belts is rotationally driven, hydraulic excavator 100 is self-propelled.

Revolving unit 2 is provided as being revolvable with respect to traveling unit 1. Revolving unit 2 mainly includes operator's cab (cab) 2*a*, operator's seat 2*b*, an engine compartment 2*c*, and a counterweight 2*d*. Operator's cab 2*a* is arranged, for example, on a front left side (a front side of a vehicle) of revolving unit 2. In an internal space in operator's cab 2*a*, operator's seat 2*b* where an operator takes a seat is arranged.

Each of engine compartment 2*c* and counterweight 2*d* is arranged on a rear side of revolving unit 2 (on a rear side of the vehicle) with respect to operator's cab 2*a*. An engine unit (an engine, an exhaust treatment structure body, etc.) is accommodated in engine compartment 2*c*. An engine hood covers engine compartment 2*c* from above. Counterweight 2*d* is arranged in the rear of engine compartment 2*c*.

Work implement 3 is supported on a front side of revolving unit 2, for example, on the right side of operator's cab 2*a*. Work implement 3 includes, for example, a boom 3*a*, an arm 3*b*, a bucket 3*c*, a boom cylinder 4*a*, an arm cylinder 4*b*, and a bucket cylinder 4*c*. Boom 3*a* has a base end pivotably coupled to revolving unit 2 by a boom foot pin 5*a*. Arm 3*b* has a base end pivotably coupled to a tip end of boom 3*a* by a boom tip end pin 5*b*. Bucket 3*c* is pivotably coupled to a tip end of arm 3*b* by a pin 5*c*.

Boom 3*a* can be driven by boom cylinder 4*a*. As the boom is driven, boom 3*a* can pivot in an upward/downward direction with respect to revolving unit 2 around boom foot pin 5*a*. Arm 3*b* can be driven by arm cylinder 4*b*. As the arm is driven, arm 3*b* can pivot in the upward/downward direction with respect to boom 3*a* around boom tip end pin 5*b*. Bucket 3*c* can be driven by bucket cylinder 4*c*. As the bucket is driven, bucket 3*c* can pivot in the upward/downward direction with respect to arm 3*b* around pin 5*c*. Work implement 3 can thus be driven.

Work implement 3 includes a bucket link 3*d*. Bucket link 3*d* includes a first link member 3*da* and a second link member 3*db*. A tip end of first link member 3*da* and a tip end of second link member 3*db* are coupled to each other as being pivotable relative to each other with a bucket cylinder top pin 3*dc* being interposed. Bucket cylinder top pin 3*dc* is coupled to a tip end of bucket cylinder 4*c*. Therefore, first link member 3*da* and second link member 3*db* are coupled to bucket cylinder 4*c* with a pin being interposed.

First link member 3*da* has a base end pivotably coupled to arm 3*b* by a first link pin 3*dd*. Second link member 3*db* has a base end pivotably coupled to a bracket at a root of bucket 3*c* by a second link pin 3*de*.

A pressure sensor 6*a* is attached to a head side of boom cylinder 4*a*. Pressure sensor 6*a* can detect a pressure (a head pressure) of hydraulic oil in a cylinder head side oil chamber 40A of boom cylinder 4*a*. A pressure sensor 6*b* is attached to a bottom side of boom cylinder 4*a*. Pressure sensor 6*b* can detect a pressure (a bottom pressure) of hydraulic oil in a cylinder bottom side oil chamber 40B of boom cylinder 4*a*.

Stroke sensors (sensing units) 7*a*, 7*b*, and 7*c* are attached to boom cylinder 4*a*, arm cylinder 4*b*, and bucket cylinder 4*c*, respectively.

A boom angle θb can be calculated from an amount of displacement of a cylinder rod 4*ab* with respect to a cylinder 4*aa* in boom cylinder 4*a*. An arm angle θa can be calculated from an amount of displacement of a cylinder rod in arm cylinder 4*b*. A bucket angle θk can be calculated from an amount of displacement of a cylinder rod in bucket cylinder 4*c*.

Potentiometers 9*a*, 9*b*, and 9*c* may be attached around boom foot pin 5*a*, boom tip end pin 5*b*, and pin 5*c*, respectively. Boom angle θb can be calculated from a measurement value from potentiometer 9*a*. Arm angle θa can be calculated from a measurement value from potentiometer 9*b*. Bucket angle θk can be calculated from a measurement value from potentiometer 9*c*.

Inertial measurement units (IMUs) 8*a*, 8*b*, 8*c*, and 8*d* may be attached to revolving unit 2, boom 3*a*, arm 3*b*, and first link member 3*da*, respectively. IMU 8*a* measures an acceleration of revolving unit 2 in a front/rear direction, a lateral direction, and an upward/downward direction and an angular velocity of revolving unit 2 around the front/rear direction, the lateral direction, and the upward/downward direction. IMUs 8*b*, 8*c*, and 8*d* measure accelerations of boom 3*a*, arm 3*b*, and bucket 3*c* in the front/rear direction, the lateral direction, and the upward/downward direction and angular velocities of boom 3*a*, arm 3*b*, and bucket 3*c* around the front/rear direction, the lateral direction, and the upward/downward direction, respectively.

IMUs 8*b*, 8*c*, and 8*d* may calculate boom angle θb, arm angle θa, and bucket angle θk, respectively. An attitude of the work implement can be known from boom angle θb, arm angle θa, bucket angle θk, a boom length, an arm length, and the like.

Hydraulic excavator 100 includes a measurement apparatus 10, a receiver 11, and a revolution angle sensor 13. Measurement apparatus 10 is a three-dimensional distance sensor and used for measurement of a height of a loaded machine 50. Measurement apparatus 10 may be implemented, for example, by an image pick-up apparatus such as a stereo camera or laser imaging detection and ranging (LIDAR).

Receiver 11 receives a signal from a transmitter of loaded machine 50. The signal received by receiver 11 includes height information of loaded machine 50. Revolution angle sensor 13 senses an angle of revolution of revolving unit 2 relative to traveling unit 1. Revolution angle sensor 13 is implemented, for example, by a sensor provided in a swing motor, a sensor that detects a tooth of swing machinery, or IMU 8*a*.

<Operations Including Stand-by State of Work Machine>

Operations including a stand-by state of the work machine will now be described with reference to FIG. 2.

Figure 2:
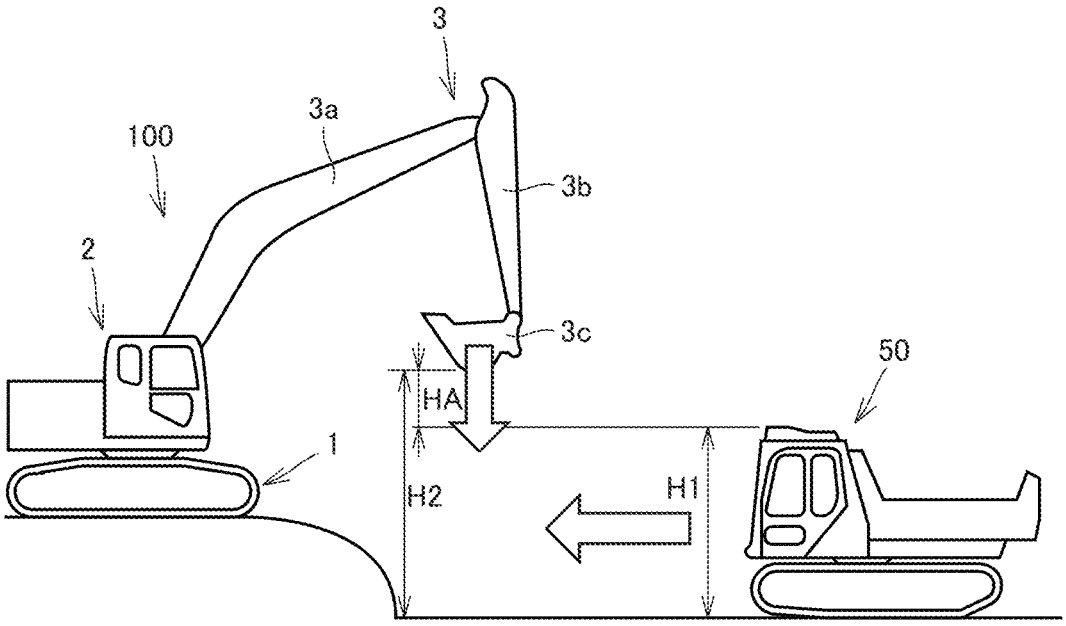
FIG. 2 is a diagram showing a state in which the work machine in one embodiment of the present disclosure waits for entry of a loaded machine.

FIG. 2 is a diagram showing a state (a stand-by state) in which the hydraulic excavator representing the work machine in one embodiment of the present disclosure waits for entry of a loaded machine. Loaded machine 50 is, for example, a dump truck. Without being limited as such, the loaded machine should only be able to carry a load such as soil and to travel. Loaded machine 50 may be, for example, a dump truck, a mobile crusher, or a belt conveyor type machine alone or in any combination.

As shown in FIG. 2, hydraulic excavator 100 representing the work machine holds a load such as soil in bucket 3*c* by doing excavation. As hydraulic excavator 100 carries out hoisting and revolving movement after excavation, bucket 3*c* of hydraulic excavator 100 reaches a set position of loading onto loaded machine 50.

While bucket 3*c* is located at a set height, hydraulic excavator 100 stands by until loaded machine 50 enters a loading site. The set height of bucket 3*c* in the stand-by state may be a certain height determined in advance.

The set height of bucket 3*c* in the stand-by state may be a height calculated based on a height of loaded machine 50 obtained by vehicle-to-vehicle communication between hydraulic excavator 100 and loaded machine 50. Alternatively, the set height of bucket 3*c* in the stand-by state may be a height calculated based on a height of loaded machine 50 obtained by measurement (image pick-up or determination) by hydraulic excavator 100.

In hydraulic excavator 100 in the present embodiment, the set height of bucket 3*c* in the stand-by state is calculated based on the height of loaded machine 50 obtained by vehicle-to-vehicle communication or the like as set forth above. Since bucket 3*c* can thus stand by at an appropriate set height for each loaded machine 50, interference of bucket 3*c* with loaded machine 50 can be avoided.

In the stand-by state, bucket 3*c* naturally lowers due to the self-weight of bucket 3*c* and the weight of the load in bucket 3*c*. As bucket 3*c* naturally lowers in the stand-by state, bucket 3*c* may interfere with loaded machine 50 that enters the loading site.

Hydraulic excavator 100 in the present embodiment senses natural lowering of bucket 3*c*. When an amount of natural lowering is equal or larger than a prescribed value, work implement 3 is controlled to raise bucket 3*c*. Interference of bucket 3*c* in the stand-by state with loaded machine 50 can thus be avoided.

As loaded machine 50 enters the loading site, the load in bucket 3*c* is ejected from bucket 3*c* and loaded onto loaded machine 50. After the load in bucket 3*c* is ejected, hydraulic excavator 100 carries out descending and revolving movement so that bucket 3*c* of hydraulic excavator 100 reaches a next excavation position. After bucket 3*c* reaches the next excavation position, next excavation is done. Thereafter, operations similar to the above are repeated.

As a platform of loaded machine 50 is fully loaded with loads as a result of repeated operations, loaded machine 50 travels from the loading site to a load ejection site.

A series of operations including excavation, hoisting and revolving movement, stand-by, ejection of loads, and descending and revolving movement may be performed in an automatic control mode without an operation by an operator. Alternatively, the series of operations may be performed by an operation by the operator.

<Hydraulic Circuit and Operation Apparatus of Work Machine>

A hydraulic circuit and an operation apparatus of the work machine will now be described with reference to FIG. 3.

Figure 3:
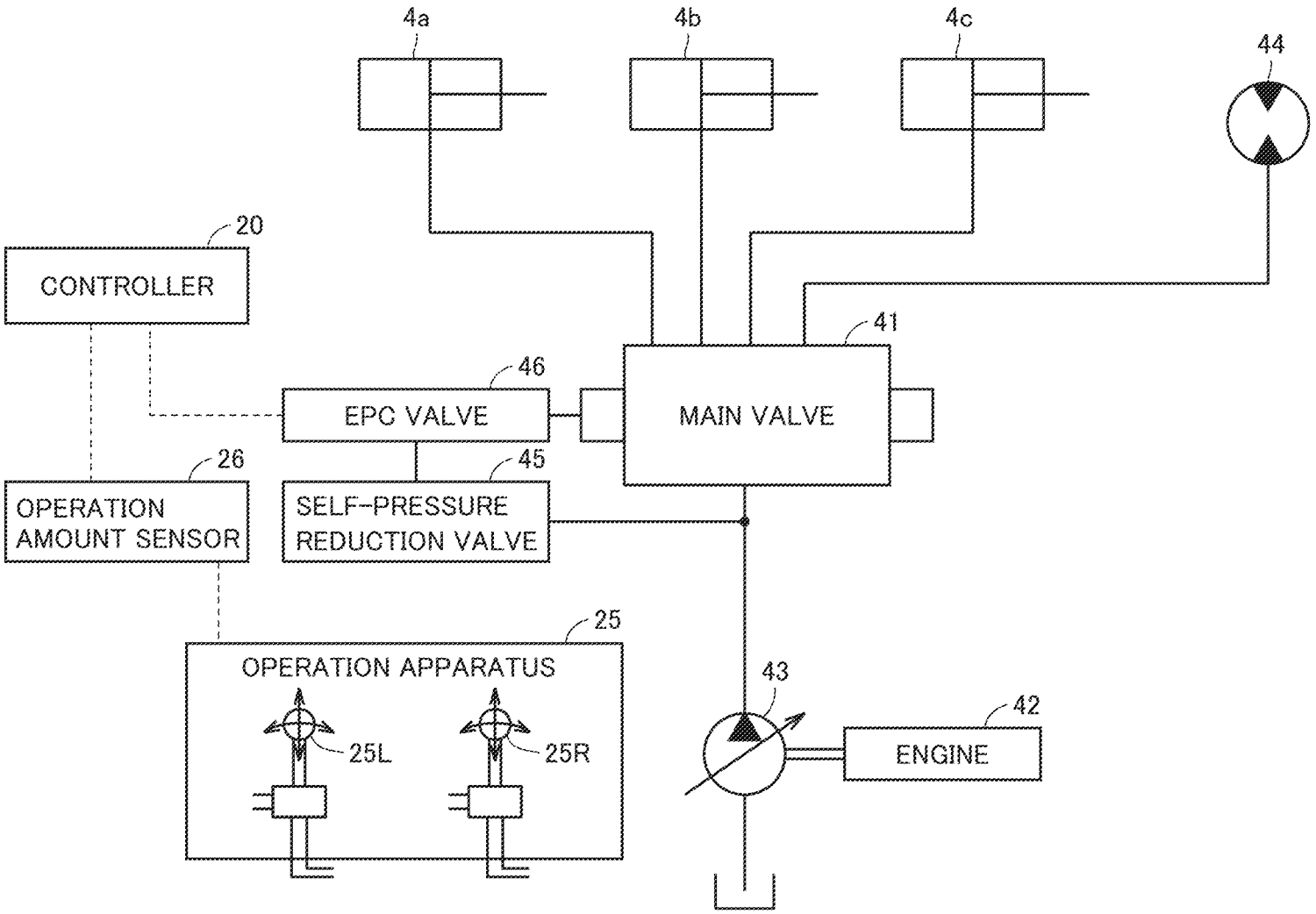
FIG. 3 is a block diagram showing a hydraulic circuit and an operation apparatus of the work machine shown in FIG. 1.

FIG. 3 is a block diagram showing a hydraulic circuit and an operation apparatus of the work machine shown in FIG. 1. As shown in FIG. 3, an engine 42 is, for example, a diesel engine. As an amount of injection of fuel into engine 42 is controlled, output of engine 42 is controlled.

A hydraulic pump 43 is coupled to engine 42. As rotational driving force of engine 42 is transmitted to hydraulic pump 43, hydraulic pump 43 is driven. Hydraulic pump 43 is, for example, a variable displacement hydraulic pump that includes a swash plate and varies a delivery capacity by changing a tilting angle of the swash plate.

Some of oil delivered from hydraulic pump 43 is supplied to a main valve 41 as hydraulic oil. Remainder of oil delivered from hydraulic pump 43 is supplied for pilot use, with a pressure thereof being reduced to a certain pressure by a self-pressure reduction valve 45. Oil with the pressure thereof being reduced to a certain pressure by self-pressure reduction valve 45 is supplied to main valve 41 through an electromagnetic proportional control (EPC) valve 46.

EPC valve 46 receives a current command from controller 20. EPC valve 46 generates a pilot pressure in accordance with a current value in the current command. EPC valve 46 drives a spool of main valve 41 with the pilot pressure.

Boom cylinder 4*a*, arm cylinder 4*b*, bucket cylinder 4*c*, and a revolution motor 44 are connected to main valve 41 as hydraulic actuators. Revolution motor 44 rotates revolving unit 2 relatively to traveling unit 1. As the spool of main valve 41 axially moves, an amount of supply of hydraulic oil to each of hydraulic actuators 4*a*, 4*b*, 4*c*, and 44 is adjusted. Operations of work implement 3 and revolution of revolving unit 2 are thus controlled.

In the present example, oil supplied to hydraulic actuators 4*a*, 4*b*, 4*c*, and 44 for activating hydraulic actuators 4*a*, 4*b*, 4*c*, and 44 is referred to as hydraulic oil. Oil supplied to main valve 41 for activating main valve 41 is referred to as pilot oil. A pressure of pilot oil is referred to as a pilot hydraulic pressure (PPC pressure).

Hydraulic pump 43 may deliver both of hydraulic oil and pilot oil as set forth above. Hydraulic pump 43 may include a hydraulic pump (a main hydraulic pump) that delivers hydraulic oil and a hydraulic pump (a pilot hydraulic pump) that delivers pilot oil separately from each other.

When hydraulic excavator 100 is in the automatic control mode, EPC valve 46 is controlled under a command from controller 20 without an operation command from an operation apparatus 25, to thereby adjust an amount of supply of hydraulic oil to each of hydraulic actuators 4*a*, 4*b*, 4*c*, and 44. When hydraulic excavator 100 is thus in the automatic control mode, the series of operations including excavation, hoisting and revolving movement, stand-by, ejection of loads, and descending and revolving movement is performed without an operation command from operation apparatus 25.

When hydraulic excavator 100 is not in the automatic control mode, EPC valve 46 is controlled under a command from controller 20 based on an operation command from operation apparatus 25. Thus, based on an operation onto operation apparatus 25, the series of operations including excavation, hoisting and revolving movement, stand-by, ejection of loads, and descending and revolving movement is performed.

Operation apparatus 25 is arranged in operator's cab 2*a* (FIG. 1). Operation apparatus 25 is operated by an operator. Operation apparatus 25 accepts an operation by the operator for driving work implement 3. In addition, operation apparatus 25 accepts an operation by the operator for revolving unit 2.

Operation apparatus 25 includes a first control lever 25R and a second control lever 25L. First control lever 25R is arranged, for example, on the right side of operator's seat 2*b* (FIG. 1). Second control lever 25L is arranged, for example, on the left side of operator's seat 2*b*. Forward, rearward, left, and right operations onto first control lever 25R and second control lever 25L correspond to biaxial operations.

For example, boom 3*a* and bucket 3*c* are operated by operating first control lever 25R. An operation in the front/rear direction onto first control lever 25R corresponds, for example, to an operation of boom 3*a*, and an operation to raise and lower boom 3*a* is performed in accordance with an operation in the front/rear direction. An operation in the lateral direction onto first control lever 25R corresponds, for example, to an operation of bucket 3*c*, and an operation in the upward/downward direction of bucket 3*c* is performed in accordance with an operation in the lateral direction.

For example, arm 3*b* and revolving unit 2 are operated by operating second control lever 25L. An operation in the front/rear direction onto second control lever 25L corresponds, for example, to an operation of arm 3*b*, and an operation in the upward/downward direction of arm 3*b* is performed in accordance with an operation in the front/rear direction. An operation in the lateral direction onto second control lever 25L corresponds, for example, to revolution of revolving unit 2, and a right revolution operation and a left revolution operation of revolving unit 2 are performed in accordance with an operation in the lateral direction.

An operation in the lateral direction onto first control lever 25R may correspond to an operation of boom 3*a*, and an operation in the front/rear direction onto the same may correspond to an operation of bucket 3*c*. The front/rear direction of second control lever 25L may correspond to an operation of revolving unit 2, and an operation in the lateral direction onto the same may correspond to an operation of arm 3*b*.

Operation apparatus 25 provides an operation signal in accordance with an operation by an operator. An amount of operation is sensed by an operation amount sensor 26 based on an operation signal provided from operation apparatus 25. Operation amount sensor 26 is implemented, for example, by a potentiometer or a hall element. A signal indicating an amount of operation sensed by operation amount sensor 26 is provided to controller 20. Controller 20 controls EPC valve 46 based on an operation command from operation apparatus 25 as set forth above.

An amount of operation adjusted by an operation onto operation apparatus 25 and sensed by operation amount sensor 26 corresponds to an operation command value in the present embodiment.

Though operation apparatus 25 is, for example, an electric operation apparatus in the present example, the operation apparatus may be a pilot hydraulic operation apparatus. When operation apparatus 25 is a pilot hydraulic operation apparatus, an amount of operation onto operation apparatus 25 is sensed, for example, by a pressure sensor that senses a pressure of oil.

<Functional Block in Controller 20>

A functional block in controller 20 shown in FIG. 3 will now be described with reference to FIG. 4.

Figure 4:
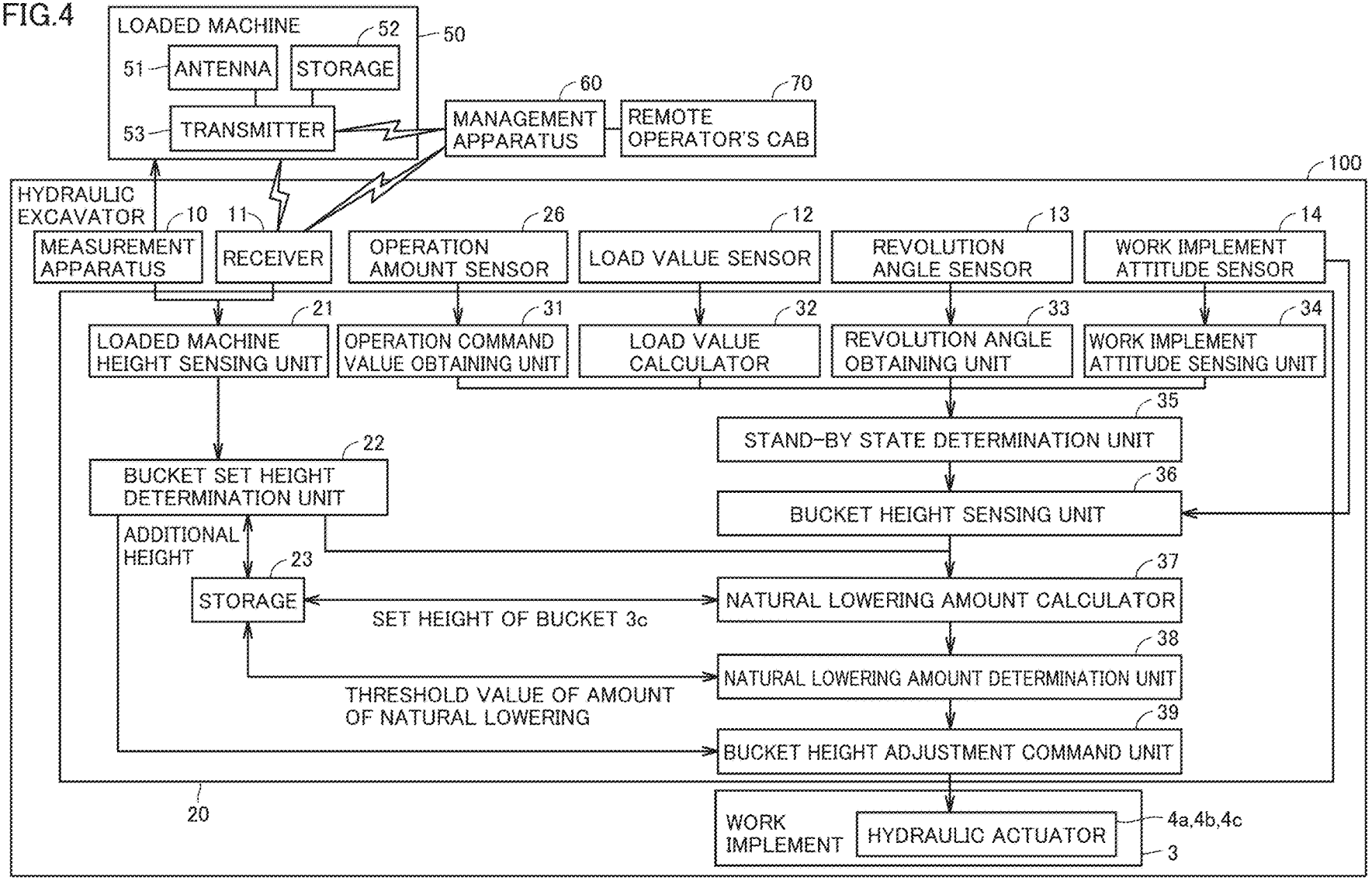
FIG. 4 is a diagram showing a functional block in a controller shown in FIG. 3.

FIG. 4 is a diagram showing a functional block in the controller shown in FIG. 3. As shown in FIG. 4, controller 20 includes a storage 23, an operation command value obtaining unit 31, a load value calculator 32, a revolution angle obtaining unit 33, a work implement attitude sensing unit 34, a stand-by state determination unit 35, a bucket height sensing unit 36, a natural lowering amount calculator 37, a natural lowering amount determination unit 38, and a bucket height adjustment command unit 39.

A set height of bucket 3*c* in the stand-by state, a threshold value of an amount of natural lowering, an additional height, and the like are stored in storage 23. Such stored information may be stored in advance in storage 23 at the time of shipment of hydraulic excavator 100 or stored in storage 23 after shipment.

Operation command value obtaining unit 31 obtains a signal indicating an amount of operation onto operation apparatus 25 as an operation command value from operation amount sensor 26. Operation command value obtaining unit 31 provides the obtained operation command value to stand-by state determination unit 35.

Load value calculator 32 obtains from a load value sensor 12, a signal of information necessary for calculating a value of a load in bucket 3*c*. Load value calculator 32 calculates a value of the load in bucket 3*c* based on the obtained information. Load value calculator 32 provides the calculated load value to stand-by state determination unit 35.

Load value sensor 12 senses information necessary for calculating the value of the load in bucket 3*c*. The value of the load in bucket 3*c* is calculated, for example, based on balance of moments of boom 3*a*, arm 3*b*, and bucket 3*c* around boom foot pin 5*a*. For calculating the value of the load, a distance from boom foot pin 5*a* to the center of gravity of boom 3*a*, a distance from boom foot pin 5*a* to the center of gravity of arm 3*b*, a distance from boom foot pin 5*a* to the center of gravity of bucket 3*c*, a weight of boom 3*a*, a weight of arm 3*b*, a weight of bucket 3*c*, and a head pressure and a bottom pressure of boom cylinder 4*a* are used. Therefore, stroke sensors 7*a* to 7*c* (or potentiometers 9*a* to 9*c* and IMUs 8*a* to 8*c*) for obtaining the distance and pressure sensors 6*a* and 6*b* that measure a head pressure and a bottom pressure of boom cylinder 4*a* fall under load value sensor 12.

Revolution angle obtaining unit 33 obtains from revolution angle sensor 13, a sensing signal indicating an angle of revolution of revolving unit 2 with respect to traveling unit 1. Revolution angle obtaining unit 33 provides the sensing signal indicating the obtained angle of revolution to stand-by state determination unit 35.

Work implement attitude sensing unit 34 obtains from a work implement attitude sensor 14, a signal of information necessary for finding an attitude of work implement 3. Work implement attitude sensing unit 34 senses the attitude of work implement 3 based on the obtained information. Work implement attitude sensing unit 34 provides information on the sensed attitude of work implement 3 to stand-by state determination unit 35.

Work implement attitude sensor 14 senses information necessary for finding the attitude of work implement 3. The attitude of work implement 3 can be found, for example, with stroke sensors 7*a* to 7*c* (or potentiometers 9*a* to 9*c* and IMUs 8*a* to 8*c*). Therefore, stroke sensors 7*a* to 7*c* (or potentiometers 9*a* to 9*c* and IMUs 8*a* to 8*c*) fall under work implement attitude sensor 14. A visual sensor (a stereo camera or a 3D scanner) may be adopted as work implement attitude sensor 14.

Stand-by state determination unit 35 determines whether or not hydraulic excavator 100 is in the stand-by state. The stand-by state refers to a state that hydraulic excavator 100 stands by with operations thereof remaining stopped until loaded machine 50 enters the loading site.

Stand-by state determination unit 35 determines that the stand-by state is set, for example, based on the fact that bucket 3*c* reaches a target ejection position by hoisting and revolving movement by hydraulic excavator 100.

Determination as to hoisting and revolving movement can be made by sensing of revolution of revolving unit 2 with respect to traveling unit 1 with bucket 3*c* carrying a load. Therefore, stand-by state determination unit 35 can determine whether or not hydraulic excavator 100 is carrying out hoisting and revolving movement based on information on the load value from load value calculator 32, information on the angle of revolution from revolution angle obtaining unit 33, and the like.

Determination as to whether or not bucket 3*c* reaches the target ejection position can be made based on sensing of the attitude of work implement 3, an angle of revolution of revolving unit 2 with respect to traveling unit 1, and the like. Therefore, stand-by state determination unit 35 can determine whether or not bucket 3*c* reaches the target ejection position based on information on the attitude of work implement 3 from work implement attitude sensing unit 34, information on the angle of revolution from revolution angle obtaining unit 33, and the like.

In making determination as to the stand-by state, stand-by state determination unit 35 may determine whether or not hydraulic excavator 100 remains stopped. When hydraulic excavator 100 is not in the automatic control mode, whether or not hydraulic excavator 100 remains stopped can be made by sensing whether or not first control lever 25R and second control lever 25L of operation apparatus 25 are in a neutral state. Therefore, stand-by state determination unit 35 can determine that hydraulic excavator 100 remains stopped based on information on the operation command value from operation command value obtaining unit 31. Alternatively, determination as to stop of hydraulic excavator 100 can also be made, for example, based on the fact that a value of an amount of spool stroke measured by a spool stroke sensor along each axis mounted on a main valve is in a dead zone of the spool. Alternatively, determination as to stop of hydraulic excavator 100 can also be made, for example, based on information on a speed of the cylinder along each axis and information on a revolution speed that are obtained from a mechatro smart (MS) cylinder and the IMU.

When stand-by state determination unit 35 determines that hydraulic excavator 100 is in the stand-by state, a determination signal is provided to bucket height sensing unit 36.

When bucket height sensing unit 36 receives a signal indicating the stand-by state from stand-by state determination unit 35, it senses the current height of bucket 3*c* based on information from work implement attitude sensor 14. Bucket height sensing unit 36 provides a signal indicating the sensed current height of bucket 3*c* to natural lowering amount calculator 37.

Natural lowering amount calculator 37 calculates an amount of natural lowering of bucket 3*c* in the stand-by state based on the current height obtained from bucket height sensing unit 36 and the set height of bucket 3*c* in the stand-by state stored in storage 23. Specifically, the amount of natural lowering ((set height)−(current height)) is calculated by subtracting the current height of bucket 3*c* from the set height of bucket 3*c*.

Alternatively, the amount of natural lowering may also be calculated, for example, by storing and holding information on the height and the attitude of bucket 3*c* at the moment of transition to the stand-by state, for example, in storage 23 and thereafter subtracting the current height of the bucket from the stored and held height of bucket 3*c*.

Natural lowering amount calculator 37 provides a signal indicating the amount of natural lowering calculated above to natural lowering amount determination unit 38.

Natural lowering amount determination unit 38 compares the amount of natural lowering obtained from natural lowering amount calculator 37 with a threshold value of the amount of natural lowering stored in storage 23. Natural lowering amount determination unit 38 determines whether or not the amount of natural lowering of bucket 3*c* in the stand-by state has exceeded the threshold value.

When natural lowering amount calculator 37 determines that the amount of natural lowering has exceeded the threshold value as a result of determination, it provides a determination signal to bucket height adjustment command unit 39.

Bucket height adjustment command unit 39 controls hydraulic actuators 4*a*, 4*b*, and 4*c* of work implement 3 to be driven based on the determination signal from natural lowering amount determination unit 38. Specifically, when natural lowering amount determination unit 38 determines that the amount of natural lowering has exceeded the threshold value, bucket height adjustment command unit 39 controls hydraulic actuators 4*a*, 4*b*, and 4*c* to be driven to raise bucket 3*c* by a height corresponding to the amount of natural lowering.

While work implement 3 is controlled to be driven, for example, work implement 3 may be controlled to be driven such that a cylinder length of each of cylinders 4*a* to 4*c* returns to the cylinder length of each of cylinders 4*a* to 4*c* before natural lowering. Alternatively, while work implement 3 is controlled to be driven, for example, a boom raising operation alone to raise the boom by the height corresponding to natural lowering of bucket 3*c* may be performed. Alternatively, while work implement 3 is controlled to be driven, for example, each of boom 3*a*, arm 3*b*, and bucket 3*c* may be driven to return to an angle of the work implement before natural lowering.

As set forth above, when natural lowering of bucket 3*c* is sensed and the amount of natural lowering is equal to or larger than a prescribed value, work implement 3 is controlled to raise bucket 3*c*.

Controller 20 includes a loaded machine height sensing unit 21 and a bucket set height determination unit 22. Loaded machine height sensing unit 21 obtains information from measurement apparatus 10 or receiver 11 and senses the height of loaded machine 50. Measurement apparatus 10 is a three-dimensional distance sensor as set forth above, and it is implemented, for example, by an image pick-up apparatus such as a stereo camera or LIDAR. When measurement apparatus 10 is implemented by a stereo camera, measurement apparatus 10 picks up an image of loaded machine 50. When measurement apparatus 10 is implemented by LIDAR, measurement apparatus 10 irradiates loaded machine 50 with pulsed laser and measures scattered light. The height of loaded machine 50 may be sensed by ultra wide band (UWB) positioning. Information obtained by measurement (image pick-up or determination) by measurement apparatus 10 is provided to loaded machine height sensing unit 21.

Receiver 11 receives a signal from a transmitter 53 of loaded machine 50 as set forth above. As receiver 11 and transmitter 53 directly communicate with each other, vehicle-to-vehicle communication between hydraulic excavator 100 and loaded machine 50 is carried out.

Alternatively, receiver 11 and transmitter 53 may communicate with each other via a management apparatus 60 (for example, a management server). In this case, each of communication between receiver 11 and management apparatus 60 and communication between transmitter 53 and management apparatus 60 is wirelessly established via a not-shown access point.

A signal received by receiver 11 includes height information of loaded machine 50. Height information of loaded machine 50 is stored, for example, in a storage 52 of loaded machine 50. In addition, a signal received by receiver 11 includes height information of the ground where loaded machine 50 is arranged (the ground at the loading site). The height of the ground where loaded machine 50 is arranged is obtained, for example, from an antenna 51 for global navigation satellite systems (GNSS) of loaded machine 50. The signal received by receiver 11 is provided to loaded machine height sensing unit 21.

Loaded machine height sensing unit 21 senses the height of loaded machine 50 based on information obtained from measurement apparatus 10 or receiver 11. Loaded machine height sensing unit 21 provides a signal indicating the sensed height of loaded machine 50 to bucket set height determination unit 22.

Bucket set height determination unit 22 obtains the height of loaded machine 50 and calculates a set height H2 of bucket 3*c* based on the height of loaded machine 50. As shown in FIG. 2, set height H2 of bucket 3*c* is a height calculated by adding an additional height HA as a margin to a height H1 of loaded machine 50 ((height H1 of loaded machine 50)+(additional height HA)). Additional height HA is stored in storage 23.

Bucket set height determination unit 22 provides the signal indicating the calculated set height to bucket height adjustment command unit 39.

Bucket height adjustment command unit 39 controls hydraulic actuators 4*a*, 4*b*, and 4*c* of work implement 3 to be driven based on the signal indicating the set height obtained from bucket set height determination unit 22. Specifically, bucket height adjustment command unit 39 controls hydraulic actuators 4*a*, 4*b*, and 4*c* to be driven such that bucket 3*c* is set to the set height.

As set forth above, set height H2 of bucket 3*c* in the stand-by state can be set to the height calculated based on the height of loaded machine 50 obtained by communication between hydraulic excavator 100 and loaded machine 50. Alternatively, set height H2 of bucket 3*c* in the stand-by state can be set to the height calculated based on the height of loaded machine 50 obtained by measurement (image pick-up or determination) by hydraulic excavator 100.

Bucket set height determination unit 22 may provide the signal indicating calculated set height H2 to natural lowering amount calculator 37. In this case, natural lowering amount calculator 37 may calculate an amount of natural lowering which is a difference between the current height obtained from bucket height sensing unit 36 and set height H2 obtained from bucket set height determination unit 22 ((set height)−(current height)). Natural lowering amount calculator 37 compares the amount of natural lowering with the threshold value stored in storage 23 and determines whether or not the amount of natural lowering of bucket 3*c* in the stand-by state has exceeded the threshold value. Based on a result of this determination, similarly to the above, bucket height adjustment command unit 39 may control hydraulic actuators 4*a*, 4*b*, and 4*c* of work implement 3 to be driven. Specifically, when natural lowering amount calculator 37 determines that the amount of natural lowering has exceeded the threshold value, bucket height adjustment command unit 39 controls hydraulic actuators 4*a*, 4*b*, and 4*c* to be driven to raise bucket 3*c* by the height corresponding to the amount of natural lowering.

As set forth above, controller 20 senses the amount of natural lowering of bucket 3*c* in the stand-by state in which hydraulic excavator 100 waits for entry of loaded machine 50 and controls work implement 3 to raise bucket 3*c* based on the amount of natural lowering.

Controller 20 senses the amount of natural lowering of bucket 3 based on the current height of bucket 3*c* sensed by work implement attitude sensor 14 (sensing unit) and set height H2 of bucket 3*c* in the stand-by state.

Controller 20 controls work implement 3 to raise bucket 3*c* by the height corresponding to the amount of natural lowering.

Controller 20 controls work implement 3 to adjust the height of bucket 3*c* to set height H2 (FIG. 2) based on information on height H1 (FIG. 2) of loaded machine 50 obtained by a height obtaining unit (receiver 11 or measurement apparatus 10).

Controller 20 is implemented, for example, by a computer, a server, or a portable terminal, or may be implemented by a central processing unit (CPU). Controller 20 may be mounted on hydraulic excavator 100 or may be provided at a remote location distant from hydraulic excavator 100.

Management apparatus 60 may be connected to a remote operator's cab 70 over a network. Remote operator's cab 70 may wirelessly be connected to the hydraulic excavator via an access point different from the above-described access point, without management apparatus 60 being interposed. Through this wireless connection, hydraulic excavator 100 may remotely be controlled from remote operator's cab 70. Remote operator's cab 70 is provided at a point distant from a work site.

Management apparatus 60 may receive a control signal for loaded machine 50 from hydraulic excavator 100 and remote operator's cab 70 and transmit the control signal to autonomous loaded machine 50. Examples of the control signal transmitted from hydraulic excavator 100 and remote operator's cab 70 to loaded machine 50 include an entry instruction signal and a pull-away instruction signal. The entry instruction signal is a signal instructing loaded machine 50 to enter the loading site. The pull-away instruction signal is a signal instructing loaded machine 50 to pull away from the loading site after completion of loading and to exit from the loading site.

<Method of Controlling Work Machine>

Control for raising bucket 3*c* when bucket 3*c* naturally lowers in the stand-by state will now be described with reference to FIG. 5.

Figure 5:
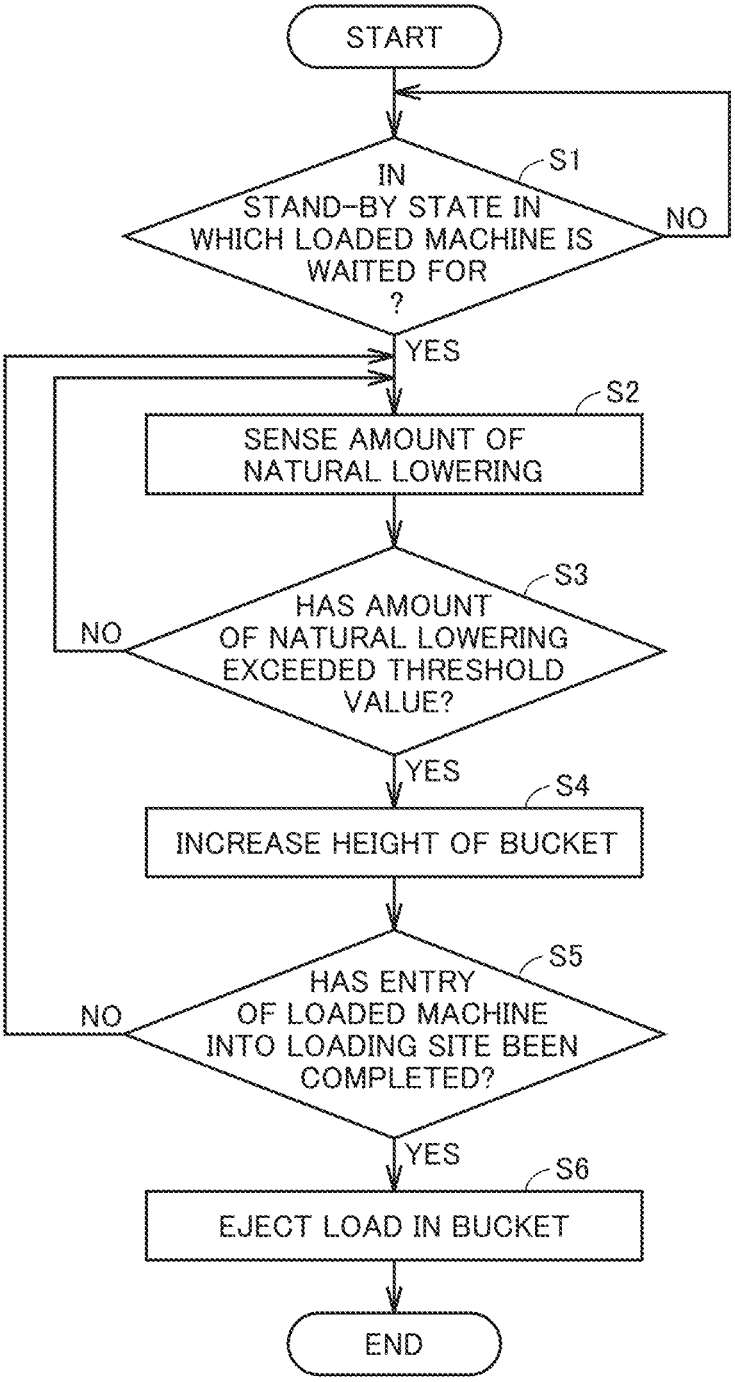
FIG. 5 is a first flowchart showing a method of controlling the work machine in one embodiment of the present disclosure.

FIG. 5 is a first flowchart showing a method of controlling the work machine in one embodiment of the present disclosure. As shown in FIG. 5, initially, whether or not hydraulic excavator 100 is in the stand-by state in which it waits for loaded machine 50 (step S1). Whether or not hydraulic excavator 100 is in the stand-by state is made based on information from operation amount sensor 26, load value sensor 12, revolution angle sensor 13, and/or work implement attitude sensor 14 shown in FIG. 4.

When hydraulic excavator 100 is determined as not being in the stand-by state, determination as to whether or not hydraulic excavator 100 is in the stand-by state is continued (step S1: FIG. 5).

When hydraulic excavator 100 is determined as being in the stand-by state, the amount of natural lowering of bucket 3*c* is sensed (step S2: FIG. 5). As shown in FIG. 4, the amount of natural lowering of bucket 3*c* is calculated by natural lowering amount calculator 37. Natural lowering amount calculator 37 calculates the amount of natural lowering based on the difference between the current height of bucket 3*c* sensed by bucket height sensing unit 36 and the set height in the stand-by state ((set height)−(current height)).

The set height stored in storage 23 is used as the set height as shown in FIG. 4. Alternatively, a set height calculated by the bucket set height determination unit may be used as the set height. Specifically, a set height based on the height of loaded machine 50 obtained by vehicle-to-vehicle communication between transmitter 53 and receiver 11 may be used. Alternatively, a set height based on the height of loaded machine 50 obtained by measurement (image pick-up or determination) by measurement apparatus 10 of hydraulic excavator 100 may be used as the set height.

After the amount of natural lowering of bucket 3*c* is sensed, whether or not the amount of natural lowering has exceeded the threshold value is determined (step S3: FIG. 5). As shown in FIG. 4, whether or not the amount of natural lowering has exceeded the threshold value is determined by natural lowering amount determination unit 38. When natural lowering amount determination unit 38 determines that the amount of natural lowering has not exceeded the threshold value, sensing of the amount of natural lowering is continued (step S2).

When natural lowering amount determination unit 38 determines that the amount of natural lowering has exceeded the threshold value, work implement 3 is controlled to raise bucket 3*c* (step S4: FIG. 5). The height of bucket 3*c* is controlled by bucket height adjustment command unit 39 as shown in FIG. 4. Bucket height adjustment command unit 39 controls hydraulic actuators 4*a*, 4*b*, and 4*c* of work implement 3 to be driven based on a determination signal from natural lowering amount determination unit 39. Bucket 3*c* is thus controlled such that the height thereof increases. Specifically, when natural lowering amount calculator 37 determines that the amount of natural lowering has exceeded the threshold value, bucket height adjustment command unit 39 controls hydraulic actuators 4*a*, 4*b*, and 4*c* to be driven to raise bucket 3*c* by the height corresponding to the amount of natural lowering.

Thereafter, whether or not entry of loaded machine 50 into the loading site has been completed is determined (step S5). When it is determined that entry of loaded machine 50 into the loading site has not been completed, sensing of the amount of natural lowering is continued (step S2).

When it is determined that entry of loaded machine 50 into the loading site has been completed, a load in bucket 3*c* is ejected into a platform of loaded machine 50 (step S6). Thereafter, hydraulic excavator 100 carries out descending and revolving movement and does next excavation or quits excavation.

As set forth above, when bucket 3*c* naturally lowers in the stand-by state, bucket 3*c* is controlled to be raised.

Control for adjusting the height of bucket 3*c* in the stand-by state to the set height will now be described with reference to FIG. 6.

Figure 6:
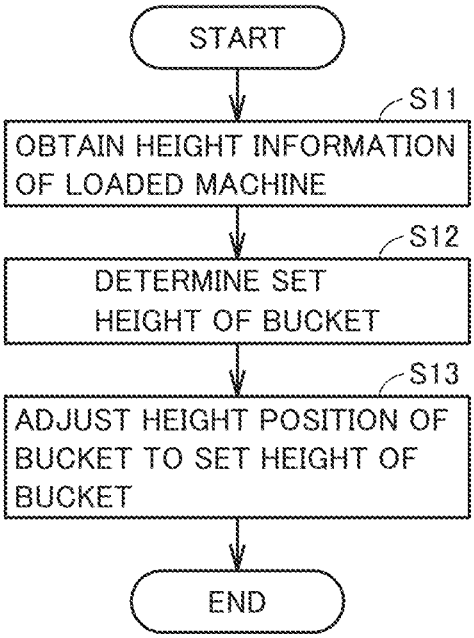
FIG. 6 is a second flowchart showing the method of controlling the work machine in one embodiment of the present disclosure.

FIG. 6 is a second flowchart showing the method of controlling the work machine in one embodiment of the present disclosure. As shown in FIG. 6, hydraulic excavator 100 obtains height information of loaded machine 50 (step S11). As shown in FIG. 4, the height information of loaded machine 50 is sensed by loaded machine height sensing unit 21 based on at least one of information obtained by measurement (image pick-up or determination) by measurement apparatus 10 and information received by receiver 11.

In sensing the height of loaded machine 50, height information of the ground where loaded machine 50 is arranged (the ground at the loading site) is referred to. The height of the ground where loaded machine 50 is arranged is obtained by antenna 51 for GNSS of loaded machine 50 and transmitter 53 transmits the information to the receiver of hydraulic excavator 100.

Based on the height information of loaded machine 50 obtained above, the set height of bucket 3*c* in loading of the load onto loaded machine 50 by hydraulic excavator 100 is determined (step S12: FIG. 6). As shown in FIG. 4, the set height of bucket 3*c* is determined by addition of the additional height as the margin to the height of loaded machine 50 by bucket set height determination unit 22.

A height position of bucket 3*c* is adjusted to set bucket 3*c* to the set height (step S13: FIG. 6). As shown in FIG. 4, the height position of bucket 3*c* is adjusted by controlling hydraulic actuators 4*a*, 4*b*, and 4*c* of work implement 3 to be driven based on a signal indicating the set height obtained by bucket height adjustment command unit 39 from bucket set height determination unit 22. Specifically, bucket height adjustment command unit 39 controls hydraulic actuators 4*a*, 4*b*, and 4*c* to be driven to set bucket 3*c* to the set height.

As set forth above, control for adjusting the height of bucket 3*c* in the stand-by state to the set height is carried out.

In sensing the amount of natural lowering (step S2) shown in FIG. 5, for calculating the amount of natural lowering based on the difference between the current height of bucket 3*c* and the set height in the stand-by state, the set height of bucket 3*c* determined in step S12 in FIG. 6 may be used as the set height.

Functions and Effects

Functions and effects of the present embodiment will now be described.

In the present embodiment, as shown in FIG. 2, in the stand-by state in which hydraulic excavator 100 waits for entry of loaded machine 50, controller 20 senses the amount of natural lowering of bucket 3*c* as shown in FIG. 4 and controls work implement 3 to raise bucket 3*c* based on the amount of natural lowering. Therefore, interference of bucket 3*c* with loaded machine 50 at the time of entry of loaded machine 50 into the loading site can be avoided.

Bucket 3*c* is raised based on the amount of natural lowering. Therefore, change in angle of bucket 3*c* in a direction of ejection of soil with natural lowering is suppressed, and drop of the load out of bucket 3*c* with change in angle of bucket 3*c* is suppressed.

According to the present embodiment, as shown in FIG. 4, hydraulic excavator 100 includes work implement attitude sensor 14 (sensing unit) that senses the current height of bucket 3*c* in the stand-by state. Controller 20 senses the amount of natural lowering of bucket 3*c* based on the current height of bucket 3*c* sensed by work implement attitude sensor 14 and the set height of bucket 3*c* in the stand-by state. The height corresponding to lowering of bucket 3*c* due to the self-weight of bucket 3*c* in the stand-by state and the load in bucket 3*c* can thus be sensed.

According to the present embodiment, as shown in FIG. 4, controller 20 controls the work implement to raise bucket 3*c* by the height corresponding to the amount of natural lowering. Bucket 3*c* can thus be controlled to be maintained at the set height.

According to the present embodiment, as shown in FIG. 4, hydraulic excavator 100 includes loaded machine height sensing unit 21 (height obtaining unit) that obtains height information of loaded machine 50 based on at least one of information transmitted from loaded machine 50 and information obtained by measurement for loaded machine 50. Controller 20 controls work implement 3 to adjust the height of bucket 3*c* to the set height based on the height information of loaded machine 50 obtained by loaded machine height sensing unit 21. The height of each loaded machine 50 can thus be sensed. Therefore, even when different loaded machines 50 enter the loading site, interference of bucket 3*c* with loaded machine 50 can reliably be avoided. Without natural lowering of bucket 3*c*, when loaded machine 50 may interfere with bucket 3*c* as it enters the loading site, the height of bucket 3*c* can be adjusted. Possibility of interference of bucket 3*c* at the time of entry of loaded machine 50 due to failure in setting bucket 3*c* to an aimed correct stand-by attitude, for example, caused by a measurement error in recognition of topography or an error in stop during control of the work implement, can thus be lowered.

According to the present embodiment, as shown in FIG. 4, hydraulic excavator 100 includes receiver 11 that receives information transmitted from loaded machine 50. Vehicle-to-vehicle communication between hydraulic excavator 100 and loaded machine 50 can thus be established, and hydraulic excavator 100 can obtain information held in loaded machine 50 (for example, height information of loaded machine 50). Bucket 3*c* can thus be adjusted to an appropriate height for each of a plurality of loaded machines 50. Therefore, even when different loaded machines 50 enter the loading site, interference of bucket 3*c* with loaded machine 50 can reliably be avoided.

According to the present embodiment, as shown in FIG. 4, hydraulic excavator 100 includes measurement apparatus 10 that conducts measurement for loaded machine 50. This measurement apparatus 100 can measure a height of loaded machine 50 for each loaded machine 50. Bucket 3*c* can thus be adjusted to an appropriate height for each of a plurality of loaded machines 50. Therefore, even when different loaded machines 50 enter the loading site, interference of bucket 3*c* with loaded machine 50 can reliably be avoided.

According to the present embodiment, as shown in FIG. 4, loaded machine 50 includes transmitter 53 that transmits height information of loaded machine 50 obtained by loaded machine height sensing unit 21 (height obtaining unit) of hydraulic excavator 100 to hydraulic excavator 100. Vehicle-to-vehicle communication between hydraulic excavator 100 and loaded machine 50 can thus be established and hydraulic excavator 100 can obtain height information of loaded machine 50 held in loaded machine 50.

It should be understood that the embodiment disclosed herein is illustrative and non-restrictive in every respect. The scope of the present invention is defined by the terms of the claims rather than the description above and is intended to include any modifications within the scope and meaning equivalent to the terms of the claims.

REFERENCE SIGNS LIST

1 traveling unit; la crawler belt apparatus; 2 revolving unit; 2*a* operator's cab; 2*b* operator's seat; 2*c* engine compartment; 2*d* counterweight; 3 work implement; 3*a* boom; 3*b* arm; 3*c* bucket; 3*d* bucket link; 3*da* first link member; 3*db* second link member; 3*dc* bucket cylinder top pin; 3*dd* first link pin; 3*de* second link pin; 4*a* boom cylinder; 4*a* hydraulic actuator; 4*aa* cylinder; 4*ab* cylinder rod; 4*b* arm cylinder; 4*c* bucket cylinder; 5*a* boom foot pin; 5*b* boom tip end pin; 5*c* pin; 6*a*, 6*b* pressure sensor; 7*a*, 7*c* stroke sensor; 9*a*, 9*b*, 9*c* potentiometer; 10 measurement apparatus; 11 receiver; 12 load value sensor; 13 revolution angle sensor; 14 work implement attitude sensor; 20 controller; 21 loaded machine height sensing unit; 22 bucket set height determination unit; 23, 52 storage; 25 operation apparatus; 25L second control lever; 25R first control lever; 26 operation amount sensor; 31 operation command value obtaining unit; 32 load value calculator; 33 revolution angle obtaining unit; 34 work implement attitude sensing unit; 35 stand-by state determination unit; 36 bucket height sensing unit; 37 natural lowering amount calculator; 38 natural lowering amount determination unit; 39 bucket height adjustment command unit; 41 main valve; 42 engine; 43 hydraulic pump; 44 revolution motor; 45 self-pressure reduction valve; 46 EPC valve; 50 loaded machine; 51 antenna; 53 transmitter; 60 management apparatus; 70 remote operator's cab; 100 hydraulic excavator

The invention claimed is:

1. A work machine that loads a load onto a loaded machine, the work machine comprising:

a work implement including a bucket, the work implement further including a boom; and a controller that senses an amount of lowering of the bucket in a stand-by state in which the bucket is carrying the load and the work machine waits to load the load onto the loaded machine, the loaded machine carrying a load and traveling, wherein the controller:

detects a current height of the bucket in the stand-by state;

calculates a descent amount of the bucket in the stand-by state based on the detected current height of the bucket and a set height of the bucket in the stand-by state; and controls the work implement to raise the bucket based on the calculated descent amount.

2. The work machine according to claim 1, further comprising:

a sensor that senses the current height of the bucket in the stand-by state, wherein the controller detects the current height of the bucket in the stand-by state using the sensor.

3. The work machine according to claim 1, wherein the controller further:

obtains height information of the loaded machine based on at least one of information transmitted from the loaded machine and information obtained by measurement for the loaded machine; and controls the work implement to adjust the height of the bucket to the set height based on the obtained height information of the loaded machine.

4. The work machine according to claim 3, further comprising a receiver that receives the information transmitted from the loaded machine.

5. The work machine according to claim 3, further comprising a measurement apparatus that conducts measurement for the loaded machine.

6. A system comprising:

the work machine according to claim 3; and a transmitter that transmits the obtained height information of the loaded machine of the work machine to the work machine.

7. A work machine that loads a load onto a loaded machine, the work machine comprising:

a work implement including a bucket, the work implement further including a boom;

and a controller, wherein the controller:

obtains height information of the loaded machine based on at least one of information transmitted from the loaded machine and information obtained by measurement for the loaded machine, the loaded machine carrying a load and traveling;

determines a set height of the bucket in loading of the load onto the loaded machine by the work machine based on the obtained height information of the loaded machine; and controls the work implement to set a height of the bucket to the determined set height of the bucket.

8. A method of controlling a work machine that includes a work implement including a bucket and loads a load onto a loaded machine, the work implement further including a boom, and the loaded machine carrying a load and traveling, the method comprising:

sensing an amount of lowering of the bucket in a stand-by state, in which the bucket is carrying the load and the work machine waits for entry of to load the load onto the loaded machine;

detecting a current height of the bucket in the stand-by state;

calculating a descent amount of the bucket in the stand-by state based on the detected current height of the bucket and a set height of the bucket in the stand-by state; and controlling the work implement to raise the bucket based on the calculated descent amount.

9. The method of controlling a work machine according to claim 8, further comprising:

obtaining height information of the loaded machine based on at least one of information transmitted from the loaded machine and information obtained by measurement for the loaded machine; and adjusting a height of the bucket based on the obtained height information of the loaded machine.

10. A method of controlling a work machine that includes a work implement including a bucket and loads a load onto a loaded machine, the work implement further including a boom, and the loaded machine carrying a load and traveling, the method comprising:

obtaining height information of the loaded machine based on at least one of information transmitted from the loaded machine and information obtained by measurement for the loaded machine;

determining a set height of the bucket in loading of the load onto the loaded machine by the work machine based on the obtained height information of the loaded machine; and controlling the work implement to set a height of the bucket to the determined set height of the bucket.

* * * * *